US005464125A

United States Patent [19]

Daansen

[11] Patent Number: 5,464,125

[45] Date of Patent: Nov. 7, 1995

[54] DISPENSING APPARATUS HAVING A PUMP TUBE

[76] Inventor: Warren S. Daansen, P.O. Box 614, Nashua, N.H. 03061

[21] Appl. No.: 384,413

[22] Filed: Feb. 6, 1995

Related U.S. Application Data

[63] Continuation-in-part of Ser. No. 24,593, Jun. 16, 1994.

[51] Int. Cl.[6] ..... B65D 35/28

[52] U.S. Cl. ..... 222/156; 222/183; 222/214; 222/181.2

[58] Field of Search ..... 222/105, 156, 222/157, 181, 182, 183, 207, 214, 325

[56] References Cited

U.S. PATENT DOCUMENTS

| | | | |
|---|---|---|---|
| D. 338,585 | 8/1993 | Bell et al. | D6/545 |
| 4,130,224 | 12/1978 | Norman et al. | 222/207 X |
| 4,349,133 | 9/1982 | Christine | 222/207 X |
| 4,394,938 | 7/1983 | Frassanito | 222/207 |
| 4,607,764 | 8/1986 | Christine | 222/207 |
| 4,621,749 | 11/1986 | Kanfer | 222/101 X |
| 4,667,854 | 5/1987 | McDermott et al. | 222/181 X |
| 4,715,517 | 12/1987 | Potter | 222/214 X |
| 4,895,274 | 1/1990 | Maldonado | 222/214 X |
| 5,105,992 | 4/1992 | Fender et al. | 222/214 X |
| 5,242,083 | 9/1993 | Christine et al. | 222/105 X |
| 5,248,066 | 9/1993 | Olson et al. | 222/214 X |
| 5,265,772 | 11/1993 | Bartasevich et al. | 222/214 |
| 5,356,039 | 10/1994 | Christine et al. | 222/207 X |
| 5,379,917 | 1/1995 | Brown et al. | 222/181 X |

*Primary Examiner*—Kevin P. Shaver
*Attorney, Agent, or Firm*—Vernon C. Maine

[57] ABSTRACT

A liquid dispenser for dispensing liquid from a container that includes a pump having an upper fitment connected to a pump tube and hence to a pump tip. The dispenser has upper and lower fitment recesses, structure for closing the lower recess, vertical pressure support wall, and pump lever that collectively constrain the pump tube to a precise operating envelope for improved pump performance and dispenser reliability. The three-section lower fitment recess provides a mechanism to grip or hold in the pump tip, and prevents lateral and longitudinal movement of the pump tip. The lower recess may have a hard interface with the extended shank of such pump tips. The dispenser has a hard, smooth, seamless exterior cover to resist build-up of scum and facilitate cleaning, closely-fitting mating edges and a latching mechanism between the cover and the back plate to resist infiltration of water. The dispenser has a sloping upper exterior surface on the push bar to shed water, an ergonomic depression in the push bar to accept the heel of the user's hand for pumping action, and a bottom edge the back side of which tapers to a small radius to minimize the accumulation of scum deposits resulting from contact with the user's wet palm and fingers.

10 Claims, 6 Drawing Sheets

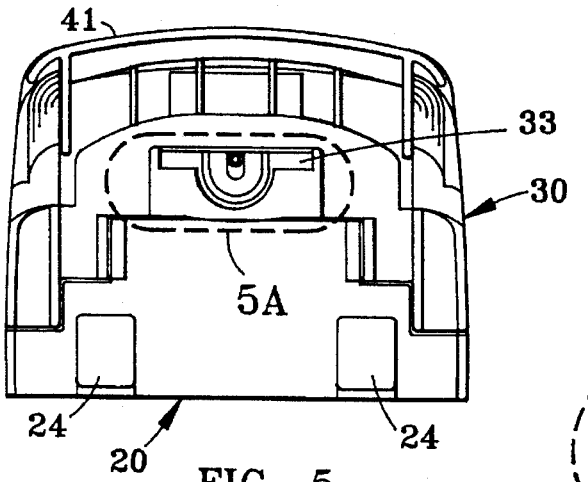
FIG. 5
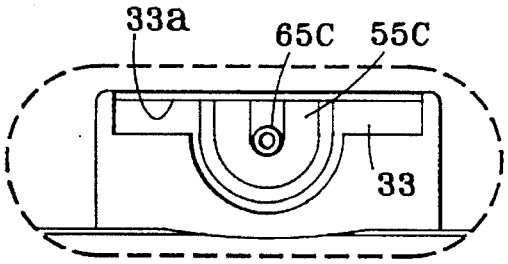
FIG. 5A
FIG. 6A
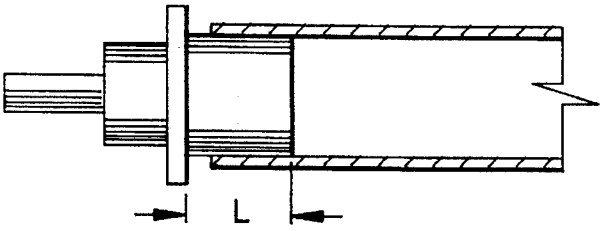
FIG. 6B
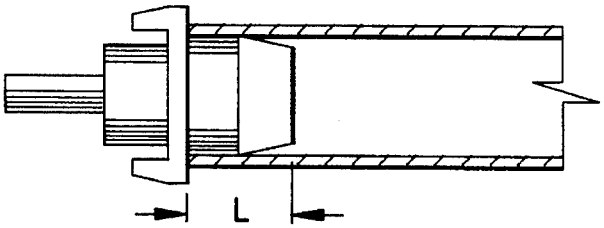
FIG. 6C
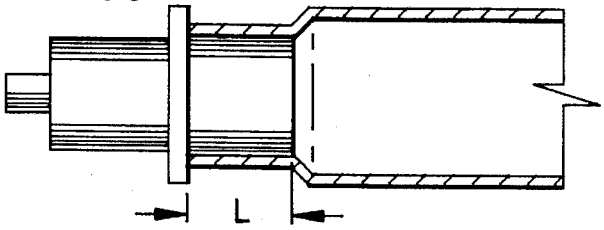
FIG. 6D
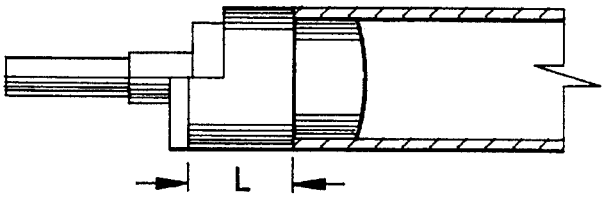
FIG. 6E
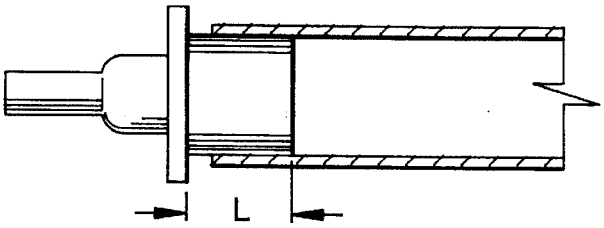

DISPENSING APPARATUS HAVING A PUMP TUBE

This application is a continuation-in-part to pending design application Ser. No. 29/024,593 entitled DISPENSER, file date Jun. 16, 1994, group art unit 2901, by the same inventor, and is related to pending utility application Ser. No. 08/357,392, entitled TIP FOR SOAP DISPENSER, file date Dec. 16, 1994, by the same inventor.

BACKGROUND OF INVENTION

1. Field of Invention

The present invention relates to liquid dispensers; particularly to wall-mounted dispensers that use liquid container systems having a collapsible bag containing the liquid, an upper fitment, a collapsible, resilient, pump tube and a pump tip with a nozzle through which the liquid is dispensed.

2. Description of Prior Art

The prior art of metered dispensing of single-use portions of fluids from dispensers using a disposable, collapsible bag and a tube to which pressure is applied for flow control, is voluminous. The most significant benefit of this methodology is that all of the components in contact with the fluid path are easily separable from the dispenser, disposable and replaceable, so that the sanitation of such systems is vastly improved over systems with permanent reservoirs and flow components which have to be regularly cleaned.

Liquids and semi-liquids such as food materials, medicines, and cleaning materials are commonly dispensed from countless numbers of existing such dispensers in use around the world. New dispensers are being added to existing markets and new markets constantly.

Wall-mounted liquid soap dispensers which dispense small portions of detergent upon application of pressure to a dispensing lever or member are commonly found in business, industry and institutional restrooms, and constitute a significant specialty industry. The installed base of soap dispensers in the United States alone is estimated at several million.

Rigid containers such as form-fitting blow-molded polyethylene jugs are known to be used with pump tubes in some dispensers, particularly in Europe. A hole is made in the top of the jug, after it is installed in the dispenser, to enable air to replace the liquid as it is consumed.

In another variation, the liquid container is supplied without a pump. The existing pump is removed from the exhausted container and attached to the new container, and reinstalled with the new container.

Many of the existing soap dispensers still use a fixed reservoir which is refilled as required, and needs to be cleaned regularly; but the industry is turning to dispensers that use disposable containers with integral pump tubes, for new and replacement installations. The improvements in ease of service, maintenance and improved sanitation are compelling reasons to use the newer system.

These "bag-in-box" containers hold the liquid soap or other desired material in a collapsible, flexible, transparent bag within a cardboard or paperboard box which is closed for shipping and storage. A pump tube is attached by an upper fitment to the bottom of the bag. The upper fitment may be a two-component rotatable fitment; a flanged upper component that is attached to the bag, and a tube coupling attached to the pump tube. At the lower end of the pump tube is a pump tip with a nozzle from which the liquid is actually expelled.

The box is installed on a shelf in the dispenser, opened for use by tearing out a perforated section in the front and bottom of the box which leaves a slot through which the pump tube is extracted and positioned against a pressure support wall, held by respective upper and lower fitment recesses.

The pump tube is typically made of extruded or molded latex or similar material, and is typically about two and one half inches long, depending on the pump tips and dispensers it is intended to fit.

There is within the pump tip a check valve that resists the free flow of fluid from the bag, but which will yield to the fluid pressure created by a pumping mechanism which squeezes the pump tube in a progressively downward direction to expel the liquid. When the pressure on the tube is removed, the lower end check valve shuts, and the tube expands to its full size, drawing in more fluid and collapsing the bag by a proportionate amount.

The system is sized so that one or two strokes of the pump lever should dispense a sufficient volume of soap for the average user's immediate use.

The check valve may be incorporated into the lower end of the pump tube, rather than actually in the pump tip. Also, some designs include a second check valve on the upper end of the pump tube to prevent back flow of fluid into the bag during the pressure stroke on the pump tube.

In some systems the volume requirement necessitates a larger diameter pump tube than the dispenser's lower recess provides for. Some manufacturers use a molded-in, necked-down tube design to provide the desired working volume and still properly fit the tube recess. This necked-down feature creates a complex pump design that is inevitably more expensive to manufacture than using simple, extruded pump hose that could be cut to length.

The industry has evolved standard dimensions to some areas of the art, such as 500, 800 and 1000 milliliter (ml) disposable soap containers, common lengths for tube/tip combinations and a common size diameter for tube/tip couplings, to which standards both dispensers and disposable soap containers are designed and produced.

The outer shape and finish of soap dispensers vary, but the operating environments are typically warm, wet, and sticky, creating conditions that readily cause the accumulation of dust, scum and grime, making sanitation and maintenance a serious issue. Cracks, slots, ribs, joints and irregular surfaces on dispensers aggravate this problem.

While new dispensers are being installed at significant rate, the market for liquid soap sales is inevitably defined by and directed to the large installed base of existing dispensers. This makes it difficult for manufacturers to introduce new dispensers or containers that depart very much from the interface standards of existing dispenser designs.

However, while container sizes, overall tube/tip length and termination diameters are standardized, internal details of pump tube and pump tip design may vary considerably. This reflects efforts by different manufacturers to improve the technical characteristics and performance of their soap container systems, to get just the right pumping action, the right amount of liquid dispensed, to prevent leaking between dispenses, and to generally improve dispenser performance.

The lower tube/tip locator recess of early dispensers was fundamentally a slot in a lower block sized to accept the lateral insertion of the outer diameter of the lower end of the pump tube.

The problem with this art is that the system depends on the tube's rigidity and the pump mechanism of the dispenser to contain the tube and tip in the recess. This was not always effective. Some pump tips and nozzles are totally unsupported and are susceptible to movement in any direction, caused by movement of the pump tube or deflection by the hand of the user. This can lead to misdirected dispenses, jams, leaks, and premature failure.

Additionally, the wet palm and fingers of the user's hand often contacts the backside, bottom edge of the pump lever when withdrawn, causing an accumulation or build-up of scum at that point. Any protruding or irregular structure on the lower back edge of the lever aggravates this problem.

Keyed elements consisting of various tabs, slots and stepped surfaces have been added to both pump tips and soap dispensers of some manufacturers to inhibit or facilitate, as the case may be, the interchangability of different soap containers and pumps with different dispensers.

Representative background art, U.S. Pat. No. 4,621,749, Kanfer, Nov. 11, 1986, and U.S. Pat. No. 5,265,772, Bartasevich, Nov. 30, 1993, disclose typical dispenser systems that use a "bag-in-box" disposable container. The disclosures and drawings clearly show the reliance on a pump tip and tube combination whereby the outer diameter of the soft wall of the pump tube extends downward into the lower tube recess and provides the majority of contacting surface for lateral restraint of the tube in operation. It is also clear that there is no structure providing specific protection against downward movement of the pump tip through the recess, and no suggestion that such would be useful.

Recent pump tip designs by this inventor, illustrated by FIG. 6D, incorporate an upwardly-extending shank between the keyed elements and the tube coupling nipple, thus displacing the lower end of the tube up out of the recess. This development permitted the use of a shorter pump tube, and offered the potential for a hard interface between the pump tip and the wall of the recess.

The pump tips and tubes of FIGS. 6A, 6B, 6C and 6E illustrate examples of the related art of pump tip designs and designate with dimension L the region that installs into the upper section of a typical lower fitment recess.

In summary, the development of dispensers is in many ways constrained by the configurations of the existing installed base of dispensers. This creates a situation where even small improvements to dispenser and container components which remain compatible with existing designs, while bringing improvements or opportunities for improvements in the maintenance and performance of dispenser/container combinations, are important in the evolution of this art.

SUMMARY OF THE INVENTION

The main purpose of the invention is to combine novel features and other improvements with the present design of liquid dispensers, in ways which will improve the maintenance and performance of the dispenser and introduce opportunities for further improvement in both dispensers and containers. Other and various objectives follow.

One object of the improved dispenser is to physically constrain the pump tube to a precise operating envelope in order to improve the immediate performance and reliability of the dispenser and to provide greater opportunity to make other adjustments and refinements to the components and operation of both the dispenser and the pump.

An additional object is to prevent the inadvertent displacement or dislodging of the pump tip from the lower fitment recess during operation of the dispenser.

Other objects are to eliminate the exposed vertical crack or seam of prior art dispensers, between the cover and the back plate, and to conceal and protect the interior of the dispenser from spray and falling water.

Still other objects of the invention are to have a lower fitment recess grip or hold the pump tip, with a vertical wall section conforming to the shape of the corresponding section of the pump tip and having keyed means to allow the use of pump tips intended to be compatible with the dispenser and to inhibit the use of potentially incompatible container systems; and further, to retain or prevent longitudinal movement or movement of the pump tip during operation while permitting the nozzle of the pump tip to protrude downward and function as intended.

Yet another object of the invention is that it work in combination with a pump tip design which includes an extended shank or upper section between any keyed elements and it's upper end tube coupling whereby the attached pump tube does not extend down into the lower fitment recess, thus providing a hard interface between the shank and the recess.

Still yet other objects of the invention are to make the pressure point or contact surface profile of the pump lever more natural or comfortable to push, to reduce the degree to which liquids, scum and bacteria may accumulate on any exterior surfaces or on the back side lower edge of the pump lever where it may often touch the wet palm and fingers of the user, and to make these surfaces easier to clean and keep clean.

Yet still other objects are to provide the dispenser with the convenience and security of automatic latching capability upon closing the cover onto the back plate, and with a simple, unobvious means for unlatching the cover for servicing.

A further object of the invention is to provide a cover that sheds liquids, resists the buildup of scum and is easy to clean, and to provide simple means for assessing when it is necessary to replenish the liquid supply in the dispenser.

BRIEF DESCRIPTION OF DRAWINGS

FIG. 5 is a bottom view of an improved dispenser.

FIG. 5A is a close-up partial view of FIG. 5 bottom view.

FIGS. 6A–6E are cross-sectional views of representative pump tubes and tips known and used in the industry.

DESCRIPTION OF PREFERRED EMBODIMENT

Figure 1:
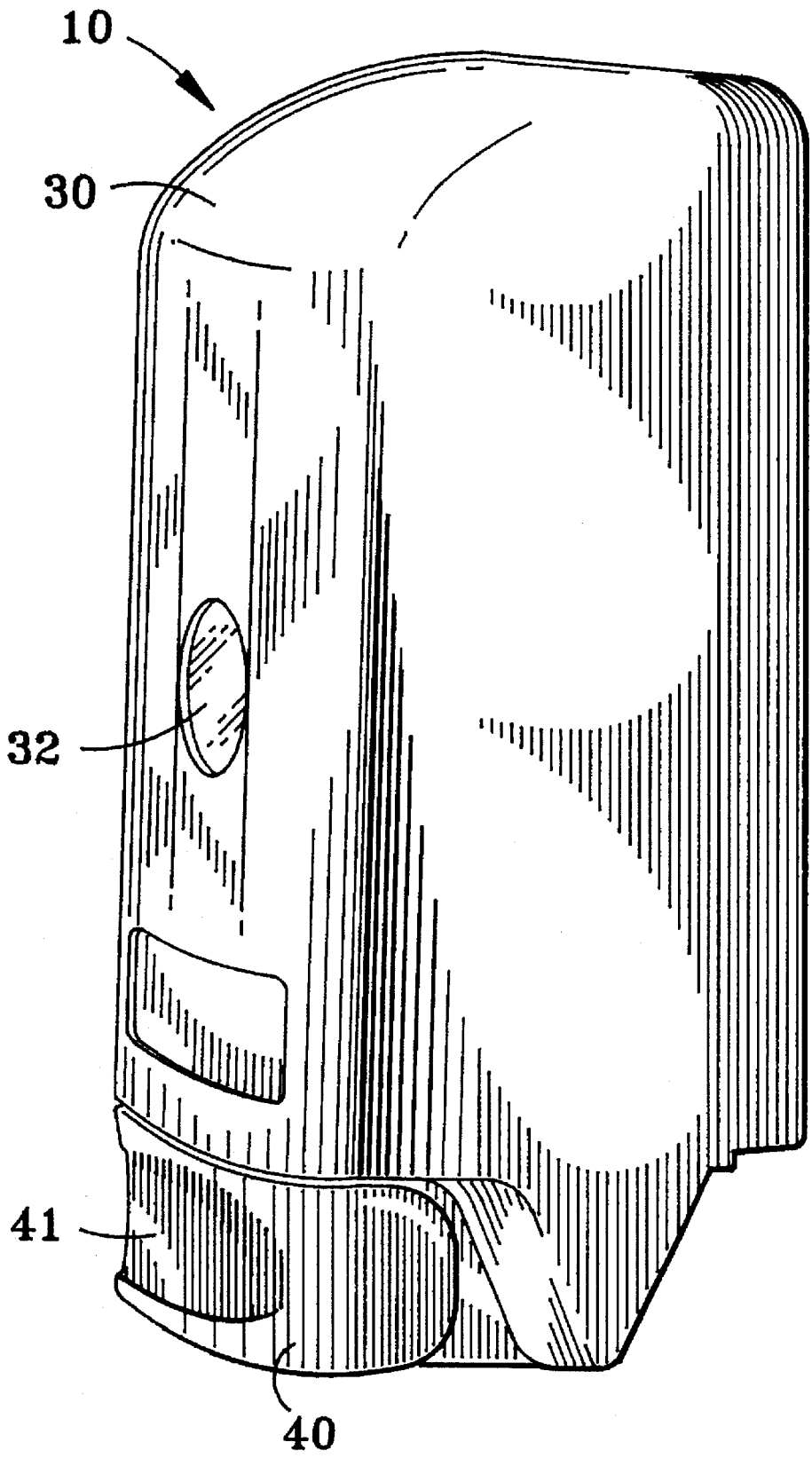
FIG. 1 is a perspective view of an improved dispenser.

According to the present invention, the foregoing and other objects and advantages are attained, for example, by an improved dispenser that uses a liquid container system having at least a container and pump, the pump comprised of an upper fitment, pump tube and pump tip, where the improved dispenser has a cover, a pump lever, and a back plate that is attachable to a flat vertical surface.

The back plate has a shelf for supporting the container, a closely-fitting upper fitment recess into which the upper fitment can be laterally inserted, a vertical pressure support wall against which the pump tube is positionable, and a closely-fitting lower fitment recess into which the pump tip can be laterally inserted.

The upper fitment recess is configured to prevent upward movement of the upper fitment and pump tube. The lower fitment recess has a lower section structure to prevent downward movement of the pump tip when the dispenser is being operated. The dispenser has a means for closing the lower fitment recess so that the pump tip is restrained from being laterally displaced out of the recess during operation.

The dispenser has a cover that can be attached in a closed position on the back plate, the cover and the back plate each having matching edge contours so that when the cover is in the closed position, the back plate and the interior of the dispenser are substantially concealed and protected from spraying and falling water.

The dispenser has a pump lever or actuator that bears on the pump tube at rest, effectively retaining the upper fitment within its respective recess, and which will collapse the pump tube against the vertical pressure support wall in a progressively downward manner when actuated by a user, causing a squirt or unit portion of liquid to be expelled into the user's palm.

The upper fitment recess, vertical pressure support wall, lower fitment recess, means for closing the lower fitment recess, and pump lever collectively constrain the pump, particularly the pump tube, to a precise, repeatable, operating envelope where the resulting performance characteristics become very stabilized. This results in improved performance and reliability, as well as creating the opportunity for further adjustments and improvements to the components and operation of both the dispenser and the container pump.

As a further example, the lower fitment recess of the improved dispenser may have three sections. An upper section has a vertically-extending wall and means therein to resist the forward movement of an installed pump tip, such as the opening being slightly smaller than it's interior width so that the corresponding section of a pump tip must be forced laterally into the recess.

Alternately, the vertically-extending wall may have molded-in knobs, buttons, ribs, or other known means to hold or grip or otherwise resist any forward movement of the pump tip out of the recess.

A middle section may have keyed elements corresponding to mating keyed elements on compatible pump tips.

A lower section has a slot from front to center so that the nozzle of the pump tip may be laterally fitted into it in a downward-pointing attitude, the nozzle and the slot being smaller in diameter than the pump tip so that the lower section prevents any downward movement of the pump tip during operation of the dispenser, and retards lateral movement to help keep the nozzle pointing properly downwards.

As another example, the improved dispenser may be used with a type of pump tip having an extended upper section or shank terminated by a pump tube coupling where the wall of the attached pump tube does not extend into the recess when the pump tip is installed. The recess/tip shank combination may be specifically designed to provide a hard interface between the shank and the recess.

As still another example, the dispenser cover may be attached to the back plate and hinged so that it can be rotated between opened and closed positions. It may have an aperture that closes over the protruding nozzle of the pump tip when the cover is closed, the leading edge of which closes and secures the pump tip in the lower fitment recess.

As yet another example, the pump lever may have a concave exterior surface profile and the contact or push point approximately conforming to the heel of a user's palm, the exterior upper surface of the pump lever may be sloped so that liquids will run off those surfaces, and the cross-section of the bottom edge at the center of the lever may taper to a small radius so that it does not readily accumulate scum build-up caused by the user's wet palm and fingers being drawn back across the bottom of the lever.

As still yet another example, the cover and back plate may be equipped with corresponding components of a self-latching mechanism that will secure the cover to the back plate when the cover is placed in the closed position, and the mechanism may be unlatched by depressing one or two inconspicuous buttons on the lower end of the dispenser.

As yet still another example, the dispenser cover may have a relatively hard, smooth, substantially seamless exterior surface which sheds water, resists build-up of dirt and scum, and is easily cleaned. It may have a flush-mounted window through which the contents of the bag may be viewed when the cover is closed.

As a further example, the improved dispenser may be used to dispense soap, body lotion, beverages, medicine, and other liquid and semi-liquid materials.

Still other objects and advantages of the present invention will become readily apparent to those skilled in this art from the following detailed description, wherein I have shown and described only a preferred embodiment of the invention, simply by way of illustration of the best mode contemplated by me on carrying out my invention. As will be realized, the invention is capable of other and different embodiments, and its several details are capable of modifications in various obvious respects, all without departing from the invention. Accordingly, the drawing and description are to be regarded as illustrative in nature, and not as restrictive.

Referring now to the drawings, improved soap dispenser 10 consists of major components back plate 20, cover 30 and pressure member 40.

Figure 2:
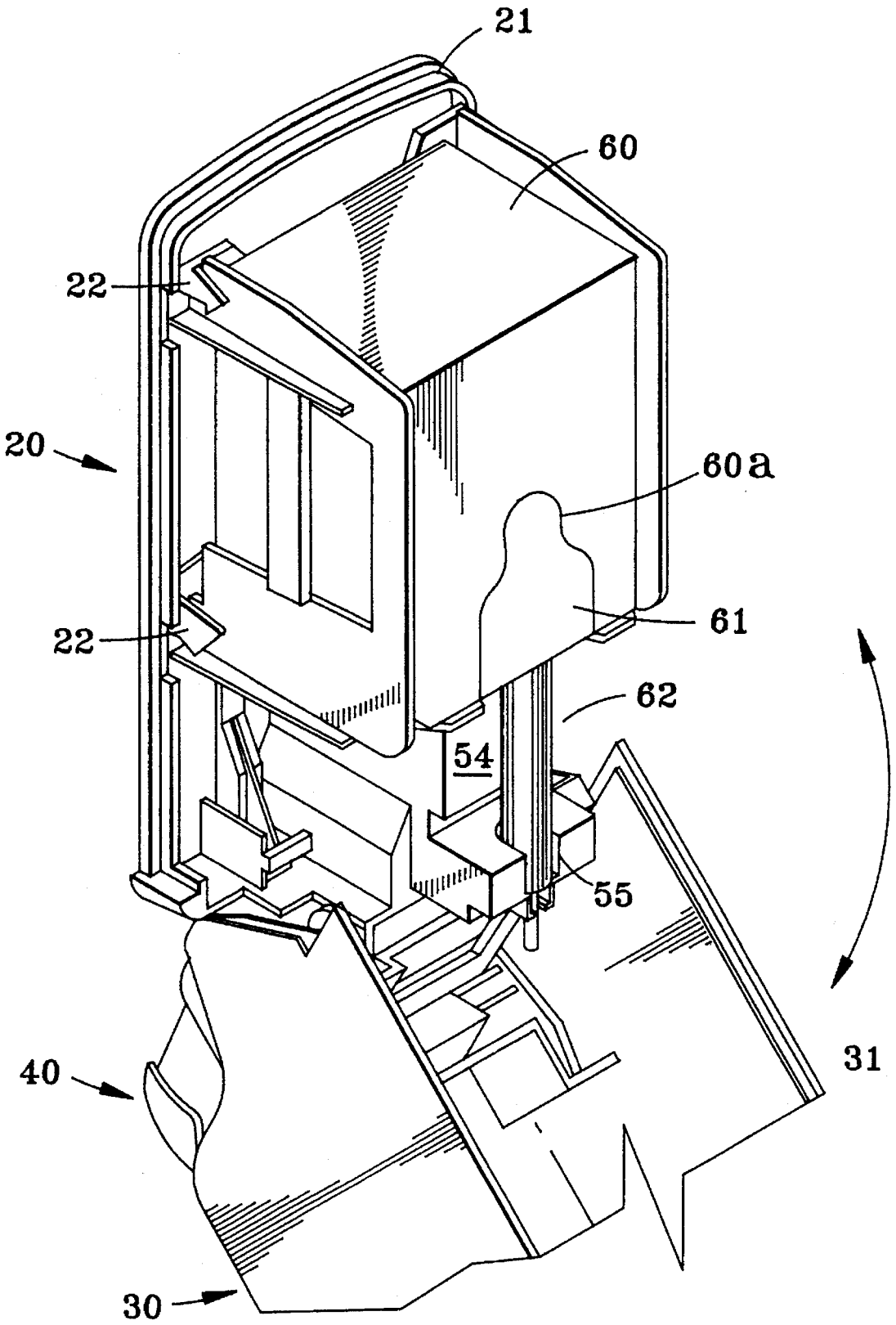
FIG. 2 is a perspective view of an improved dispenser with the cover open, and loaded with a container of liquid soap.

Referring to FIGS. 1 and 2, cover 30 is pivotally connected by a hinge mechanism to back plate 20 so that cover 30 swings forward and down to an open position which makes the interior portion of back plate visible and accessible for servicing; then upward and back over back plate 20 to a closed position which substantially conceals the front, sides and top of back plate 20 and the interior of the dispenser. Back side of back plate 20 may be readily attached by any known means to a vertical surface or wall as in a bathroom or shower.

Figure 4:
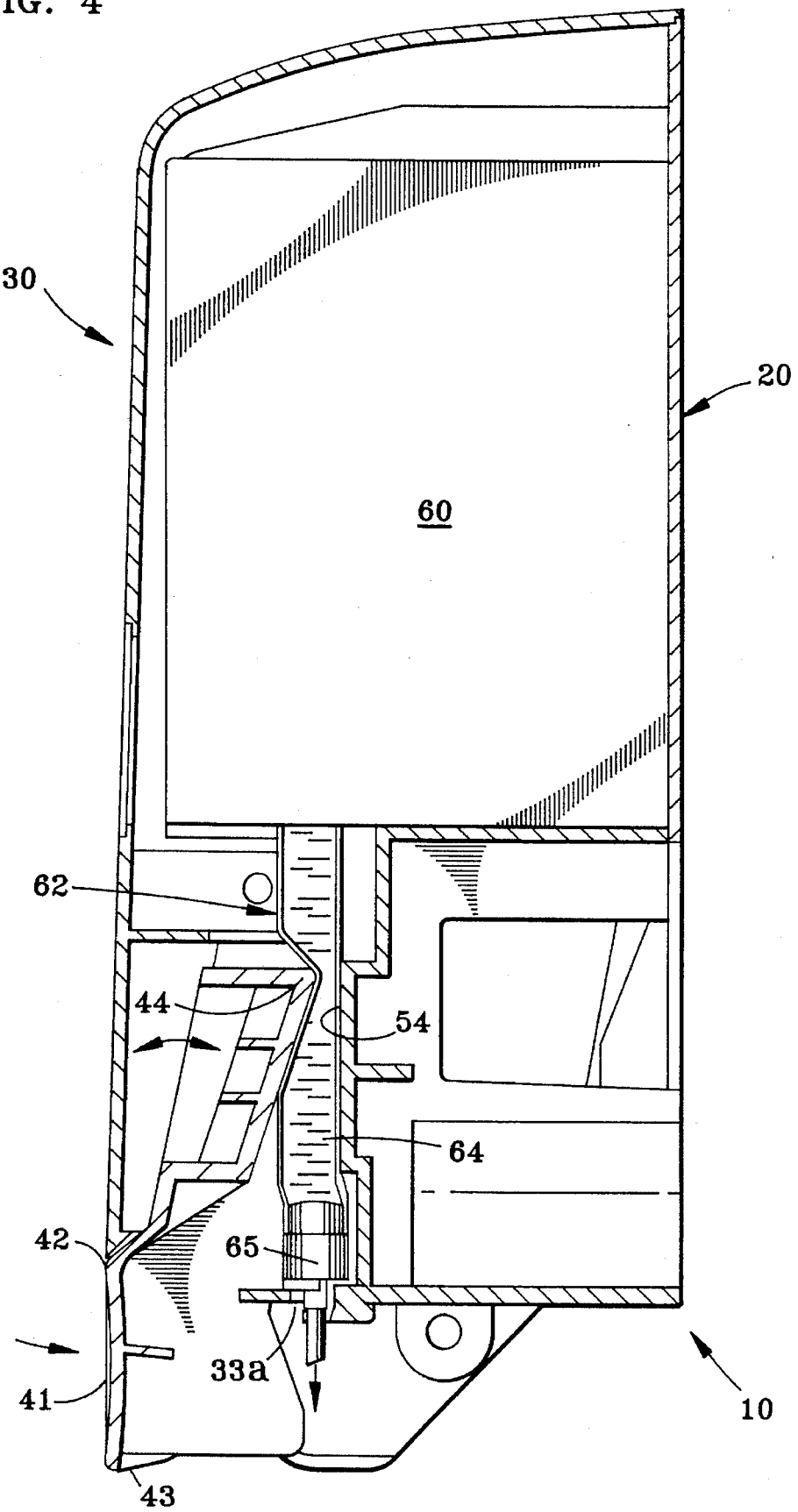
FIG. 4 is a cross-sectional view of an improved dispenser, loaded with a container of liquid, closed, and ready to dispense.

Referring to FIG. 1, surface of cover 30 has a hard, smooth finish without vertical seams, joints or cracks, which sheds water readily and is easily cleaned with soap and water. Referring to FIG. 4, exterior surface of pressure member 40 has a similar hard, smooth finish, and is configured with a sloping upper surface 42 to likewise readily shed water.

Referring to FIG. 4, pressure member 40 is pivotally connected to the interior of cover 30 to provide a fore and aft arc of movement. Face 41 of pressure member 40 is visible and accessible at the lower end of cover 30 and has a slightly dished or concave surface that comfortably accepts the heel of a user's hand or palm for applying the pumping stroke. A push on pump lever 40 of loaded dispenser 10 causes a small amount of soap to be dispensed from the bottom of dispenser 10 into the cupped palm and fingers of the user's hand, as further described herein.

The back side and bottom edge 43 of pressure member 40 does not have any sort of shelf or ribbed surface, but tapers to a small radius. This minimizes the build-up of scum on the back edge of the pump lever resulting from repeated contact with the user's wet palm and fingers, and makes this area easier to clean.

Referring to FIGS. 1, 2 and 4, mating edge 31 of cover 30 closes over a closely-fitting corresponding mating edge 21 on back plate 20, thereby resulting in a closed dispenser with no visible scum-prone seams between back plate 20 and cover 30, and provides excellent protection against infiltration of dust, soap, falling water and shower spray.

Referring to FIGS. 2 and 4, improved dispenser 10 is designed to be loaded with disposable container 60 of liquid hand soap. Container 60 is of the conventional "bag-in-box" design and includes a flexible, substantially transparent, collapsible bag 61 containing liquid hand soap, to which is attached pump 62. Pump 62 consists of upper fitment 63, to which is attached collapsible, resilient pump tube 64 made of extruded or molded latex, and pump tip 65 which is attached to the lower end of pump tube 64. Bag 61 may or may not be contained in a box, from which combination the name derives.

Upper fitment 63 has a flange at it's upper end and a tube coupling at it's lower end. Pump tip 65 has an upper section or shank **65*a* which terminates in a tube coupling, a middle section 65*b* which has keying elements to enable it's use in compatibly keyed dispensers, and a lower section 65*c*** which is the nozzle from which the liquid is actually expelled when the pump is actuated.

Referring to FIG. 2, tube 64 with attached tip 65 may be folded and stored within container 60 during shipping and storage. For installation, container 60 is placed on shelf 50. Tear strip **60*a* is removed. Fitment 63, tube 64 and tip 65 are extracted and extended downwards, and properly positioned in the open dispenser as further described below. Cover 30** is then swing up and closed, and the improved dispenser is ready to use.

Referring to FIGS. 1 and 4, cover 30 includes window 32 for observing the level of the contents of bag 61.

Referring to FIGS. 2, 3, 3A and 3B, located on back plate 20 are outwardly-projecting shelf 50, and forward-facing upper fitment recess 53, vertical pressure support wall 54, and lower fitment recess 55. Upper fitment recess 53 is configured to accept the lateral insertion of upper fitment 63 in a closely-fitting relationship whereby the fitment is constrained from longitudinal movement when the dispenser is closed and operable.

Figure 3:
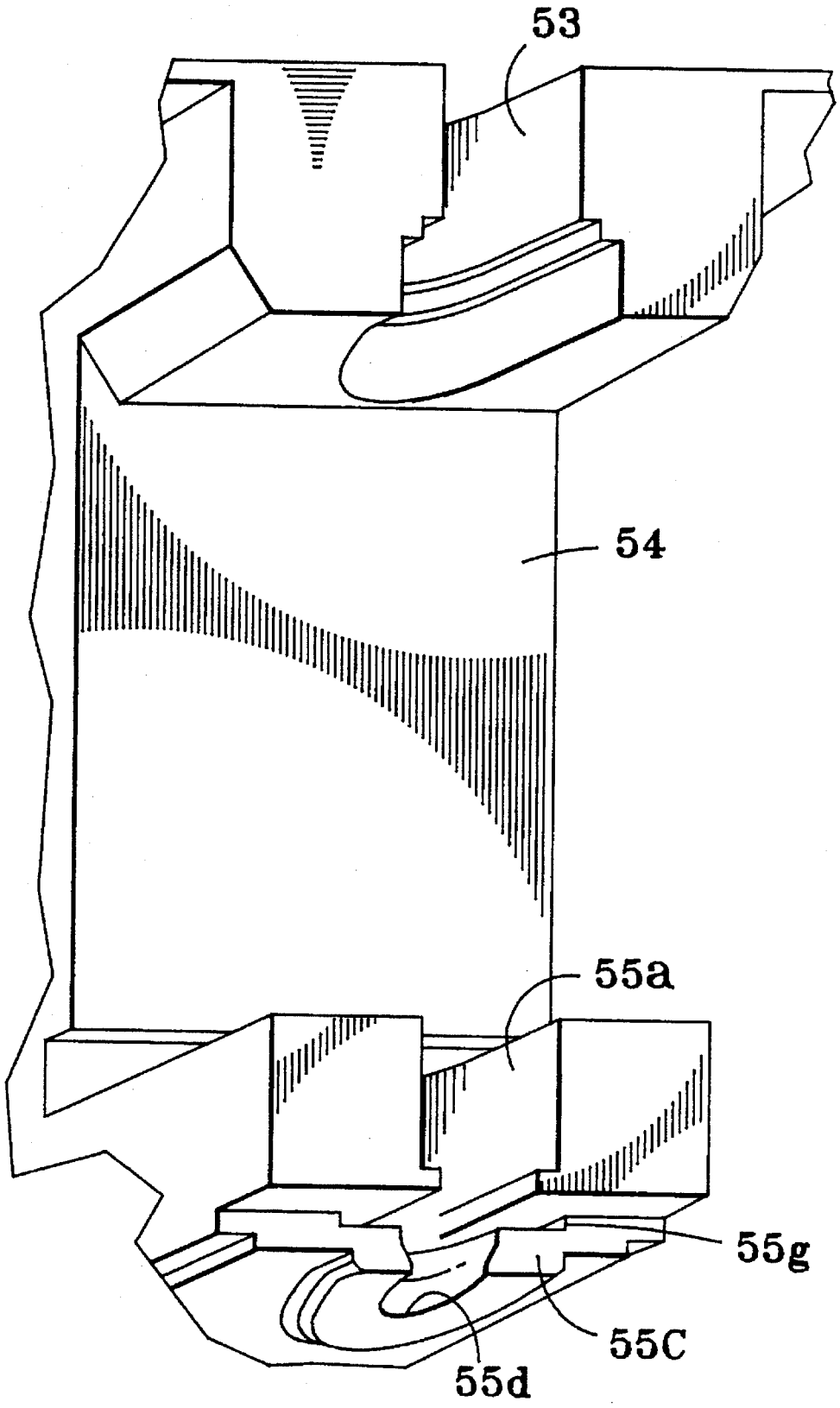
FIG. 3 is a close-up partial perspective view of the pump retention components of the dispenser.
Figure 3A:
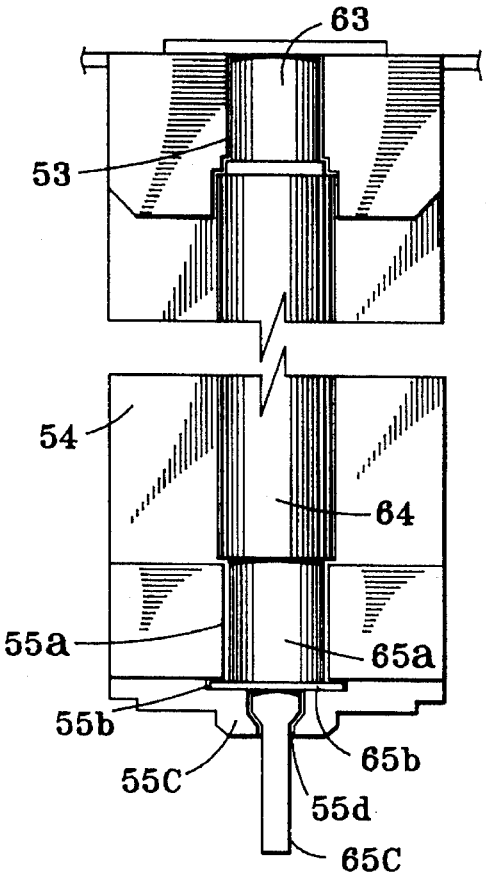
FIG. 3A is a partial front view of a lower fitment recess configured for and shown with an extended shank pump tip.
Figure 3B:
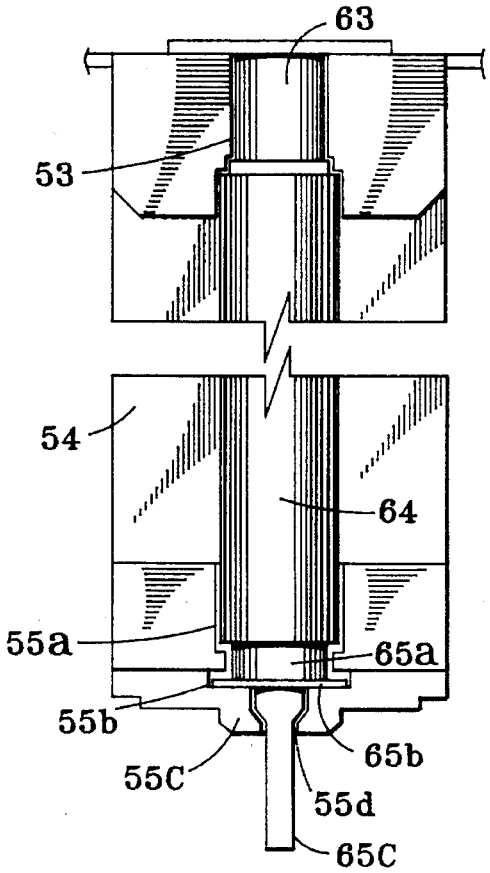
FIG. 3B is a partial front view of a lower fitment recess configured for and shown with a common pump tip.

Referring to FIGS. 3, 3A, and 3B, upper fitment recess 53 is configured to restrain installed upper fitment 63 from any longitudinal movement.

Referring to FIGS. 3 and 6A–E, lower fitment recess 55 has three sections. Upper section **55*a* is comprised of vertically-extending side and back walls, the back wall being of a semi-circular cross section closely matching the cross section dimensions of the corresponding length L of compatible tube/tip combinations as typified by those pump tips of FIGS. 6A–6E. Middle section 55*b* is comprised of keyed elements such as slots and stepped surfaces corresponding to the section 65*b* keyed mating elements such as the tabs of compatible tube/tip combinations. Lower section 55*c* is a hemispherical retention structure or appendage which effectively closes the bottom of recess 55 except for slot 55*d* which is sized to accept lateral insertion of downward-pointing tip nozzle 65*c* while supporting and restraining pump tip 65** from any downward movement.

Referring to FIG. 4, the lower edge of vertical pressure support wall 54 is located about one tube width higher than the top of recess 55, and slightly forward of the back wall of recess 55. Pump tube 64 is thereby slightly deformed when tip 65 is fully inserted into recess 55. Cam surface 44 of pump lever 40 bears on and partially deforms tube 64 against wall 54 when in at rest or in a relaxed position. Cam surface 44 then collapses tube 64 in a progressively downward manner against wall 54 when pump lever 40 is actuated.

Figure 3C:
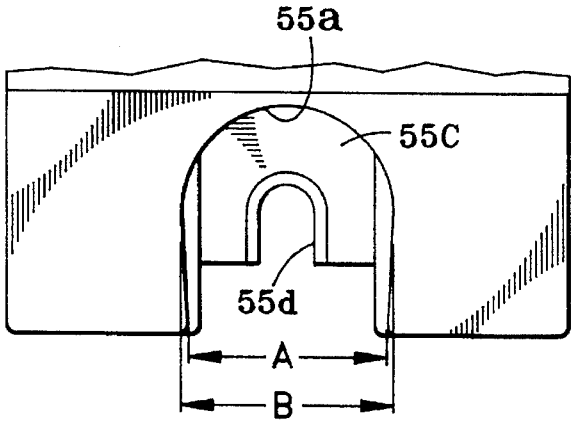
FIG. 3C is a partial top view of a lower fitment recess.

Referring to FIG. 3C, upper section **55*a* is slightly narrower at it's opening, dimension A, than at its widest point, dimension B, thereby providing a snap-in fit installation with a hard interface for a pump tip with an extended shank 65*a*, such as illustrated by the tip of FIG. 6D, or alternately, a snug, push-in or compression fit for tips with the wall of pump tube 63 extending into length L portion of the tip, as illustrated by the tips of FIGS. 6**A–C and E.

In the case of tips with the extended shank, the resulting hard interface between recess section **55*a* and shank 65*a* provides a more precise and stable support means for pump tip 65 and pump tube 64 than for pumps supported by and through the latex wall of the pump tube/tip combinations represented by FIGS. 6A–C and 6**E.

Back plate 20 and cover 30 are equipped with corresponding components of self-latching mechanism 22, which latches automatically when cover 30 is pushed into a closed position on back plate 20. Latch mechanism 22 may be unlatched by pressing one or both of buttons 24 on the lower end or underside of dispenser 10.

Referring to FIGS. 4, 5 and 5A, cover 30 is configured with aperture 33, leading edge **33*a* of which closes slot 55*d* when cover 30 is closed, thereby restraining tip 65** from forward movement or displacement during operation of the dispenser.

The combined constraints on pump 62 of upper fitment recess 53, vertical pressure support wall 54, lower fitment recess 55, cam surface 44, and aperture edge 32A, precisely secure pump tube 64 within a clearly defined operating envelope, which provides a more consistent pumping action and volume, and generally improves performance and reliability of the dispenser as well as introducing opportunities to more-closely match pump and dispenser characteristics.

While the drawings and the specification present a clearly understandable disclosure of a preferred embodiment of the present invention, it is to be understood that the invention is not limited to the specific form disclosed, but covers all modifications, changes and alternative constructions falling within the scope of the claims in light of this disclosure.

What is claimed is:

1. An improved dispenser for dispensing liquid, for use with liquid container of the type having a pump comprised of an upper fitment connected to a pump tube and hence to a pump tip, said improved dispenser comprising:

a back plate, back side thereof being attachable to a flat vertical surface, front side thereof having means for supporting said container, an upper fitment recess within which said upper fitment may be laterally installed in a closely-fitting relationship and which is configured to restrain longitudinal movement of said upper fitment, a vertical pressure support wall against which said pump tube may be positioned, and a lower fitment recess within which said pump tip may be laterally installed in a closely-fitting relationship and which is configured to restrain longitudinal movement of said pump tip;

a full cover attachable to said front side of said back plate at corresponding mating edge contours so as to form an interior cavity and substantially conceal and protect said back plate and said interior from spraying and falling water;

a pump lever bearing on said pump tube at rest and collapsing in a downward manner said pump tube against said vertical pressure support wall when said pump lever is actuated by a user, thereby expelling a unit portion of said liquid into said user's palm; and means for closing said lower fitment recess;

said upper and lower fitment recesses, said means for closing said lower fitment recess, said vertical pressure support wall and said pump lever thereby collectively constraining said pump tube to a precise operating envelope.

2. The improved dispenser of claim 1, said lower fitment recess comprising three sections, an upper section having a vertically-extending wall, the opening of which section is slightly smaller than it's interior width such that a corresponding section of said pump must be forced laterally thereinto, a middle section having keyed elements corresponding to mating elements of said pump tip such that said pump tip may be laterally received therein and be thereby restrained from upward movement, and a lower section having a slot from front to center such that the nozzle of said pump tip may be laterally received therein in a downward-pointing attitude, said nozzle and said slot being of smaller diameter than said pump tip whereby said lower section prevents downward movement of said pump tip.

3. The improved dispenser of claim 2, wherein said dispenser is used with a pump tip having an extended shank terminated by a pump tube coupling such that said pump tube does not extend into said lower fitment recess when said pump tip is installed therein.

4. The improved dispenser of claim 1, said cover being hingedly attached to said back plate such that said cover may be rotated between an opened position and a closed position, said means for closing said lower fitment recess comprising an aperture on a lower end of said cover having a leading edge which closes over said nozzle when said cover is moved to said closed position, leading edge of said aperture thereby closing said lower fitment recess and securing said pump tip therein.

5. The improved dispenser of claim 1, said pump lever having a hard, smooth finish, a concave exterior surface profile approximately conforming to the heel of a user's palm, a sloping exterior upper surface such that liquids deposited thereon run off easily, and a bottom edge center cross-section tapering down to a small radius to inhibit any accumulation of said liquid on the back edge thereof caused by contact with said liquid on a user's palm and fingers.

6. The improved dispenser of claim 1, said cover and said back plate equipped with corresponding components of a self-latching mechanism which secures said cover to said back plate when said cover is attached in said closed position, said mechanism being unlatched by depressing at least one button on the lower end of said dispenser.

7. The improved dispenser of claim 1, said cover having a relatively hard, smooth, seamless exterior surface, and a window through which the contents of said container may be viewed when said cover is in said closed position.

8. The improved dispenser of claim 1, said liquid being soap.

9. An improved dispenser for dispensing liquid, for use with liquid container of the type having a pump comprised of an upper fitment connected to a pump tube and hence to a pump tip, said improved dispenser comprising:

a back plate, back side thereof being attachable to a flat vertical surface, front side thereof having means for supporting said container, an upper fitment recess within which said upper fitment may be laterally installed in a closely-fitting relationship and which is configured to restrain longitudinal movement of said upper fitment, a vertical pressure support wall against which said pump tube may be positioned, and a lower fitment recess within which said pump tip may be laterally installed in a closely-fitting relationship and which is configured to restrain longitudinal movement of said pump tip;

a full cover attachable to said front side of said back plate at corresponding mating edge contours so as to form an interior cavity and substantially conceal and protect said back plate and said interior from spraying and falling water;

a pump lever bearing on said pump tube at rest and collapsing in a downward manner said pump tube against said vertical pressure support wall when said pump lever is actuated by a user, thereby expelling a unit portion of said liquid into said user's palm; and means for closing said lower fitment recess;

said upper and lower fitment recesses, said means for closing said lower fitment recess, said vertical pressure support wall and said pump lever thereby collectively constraining said pump tube to a precise operating envelope;

said lower fitment recess comprising three sections, an upper section having a vertically-extending wall, the opening of which section is slightly smaller than it's interior width such that a corresponding section of said pump must be forced laterally thereinto, a middle section having keyed elements corresponding to mating elements of said pump tip such that said pump tip may be laterally received therein and be thereby restrained from upward movement, and a lower section having a slot from front to center such that the nozzle of said pump tip may be laterally received therein in a downward-pointing attitude, said nozzle and said slot being of smaller diameter than said pump tip whereby said lower section prevents downward movement of said pump tip, said cover being hingedly attached to said back plate such that said cover may be rotated between an opened position and a closed position, said means for closing said lower fitment recess comprising an aperture on lower end of a cover having a leading edge which closes over said nozzle when said cover is moved to said closed position, thereby closing said lower fitment recess and securing said pump tip therein.

said pump lever having a hard, smooth finish, a concave exterior surface profile approximately conforming to the heel of a user's palm, a sloping exterior upper surface such that liquids deposited thereon run off easily, and a bottom edge center cross-section tapering down to a small radius to inhibit any accumulation of said liquid on the back edge thereof caused by contact with said liquid on a user's palm and fingers, said cover and said back plate equipped with corresponding components of a self-latching mechanism which secures said cover to said back plate when said cover is attached in said closed position, said mechanism being unlatched by depressing at least one button on the lower end of said dispenser, said cover having a relatively hard, smooth, seamless exterior surface, and a window through which the contents of said container may be viewed when said cover is in said closed position, said liquid being soap.

10. The improved dispenser of claim 9, wherein said dispenser is used with a pump tip having an extended shank terminated by a pump tube coupling such that said pump tube does not extend into said lower fitment recess when said pump tip is installed therein.

* * * * *